US008020220B2

(12) United States Patent
McElroy et al.

(10) Patent No.: US 8,020,220 B2
(45) Date of Patent: Sep. 20, 2011

(54) CUSTOMIZABLE MILITARY HELMET SYSTEM

(75) Inventors: Michael McElroy, Gilbert, AZ (US); Fielder Stanton Lyons, Phoenix, AZ (US)

(73) Assignee: BAE Systems Land & Armaments, Phoenix, AZ (US)

( * ) Notice: Subject to any disclaimer, the term of this patent is extended or adjusted under 35 U.S.C. 154(b) by 526 days.

(21) Appl. No.: 12/246,272

(22) Filed: Oct. 6, 2008

(65) Prior Publication Data

US 2011/0197327 A1 Aug. 18, 2011

(51) Int. Cl.
*A42B 1/24* (2006.01)

(52) U.S. Cl. ..... 2/467; 297/216.12; 428/174; 524/424

(58) Field of Classification Search ..... 2/467, 468, 2/242, 422; 297/216.12, 250.1; 345/156, 345/419, 441, 157, 8, 169; 359/630, 822; 428/411.1, 113, 174, 212; 524/111, 424, 524/447, 445; 361/679.06, 679.21
See application file for complete search history.

(56) References Cited

U.S. PATENT DOCUMENTS

| | | | | |
|---|---|---|---|---|
| 4,195,328 | A | 3/1980 | Harris, Jr. | |
| 4,744,107 | A | 5/1988 | Föhl | |
| 5,317,643 | A | 5/1994 | Patricelli | |
| 5,704,707 | A | 1/1998 | Gebelein et al. | |
| 6,009,561 | A | 1/2000 | Bullock et al. | |
| 6,075,857 | A | 6/2000 | Doss, Jr. et al. | |
| 6,113,243 | A | 9/2000 | Saul | |
| 6,472,776 | B1 * | 10/2002 | Soto et al. | 307/400 |
| 6,732,381 | B1 | 5/2004 | Lal | |
| 6,798,392 | B2 | 9/2004 | Hartwell et al. | |
| 6,804,829 | B2 * | 10/2004 | Crye et al. | 2/6.6 |
| 7,308,108 | B2 | 12/2007 | Davis | |
| 2006/0248623 | A1 | 11/2006 | Miller | |
| 2006/0277664 | A1 | 12/2006 | Akhtar et al. | 2/410 |
| 2006/0279115 | A1 * | 12/2006 | Tisdelle | 297/216.12 |
| 2007/0022520 | A1 | 2/2007 | Grassl et al. | 2/424 |
| 2008/0130271 | A1 | 6/2008 | Harris | 362/105 |
| 2008/0141429 | A1 | 6/2008 | Scharpenack et al. | |

* cited by examiner

*Primary Examiner* — Hung V Duong
(74) *Attorney, Agent, or Firm* — Pillsbury Winthrop Shaw Pitman LLP

(57) ABSTRACT

A helmet system that enables a user of the helmet system to customize the helmet system according to personal taste, a task at hand, responsibilities within a tactical group (e.g., communications, command, etc.), and/or according to other parameters. The customization of the helmet system may include a customization of electronics modules carried on the helmet system that optionally provide communications, environment detection, health or biometrics monitoring, power, information transmission/reception, information processing, and/or other functionalities. The customization of the helmet system may include a customization of structural components that enable the user to balance the structural protection provided to the user against other considerations. The other considerations may include, for example, weight, form factor, comfort, and/or other considerations.

21 Claims, 2 Drawing Sheets

CUSTOMIZABLE MILITARY HELMET SYSTEM

The U.S. Government has certain rights in this invention in accordance with the terms of Contract No. W911QY-07-C-0089, awarded by the Natick Contracting Division.

FIELD OF THE INVENTION

The invention relates to a customizable military helmet system that enables a user to customize the protection and/or electronic functionality of the helmet.

BACKGROUND OF THE INVENTION

Helmets have been used in military applications since ancient times. In general, the primary function of military helmets has been protection. In particular, in modern times, military helmets provide protection against ballistic projectiles such as bullets and/or shrapnel. As such, military helmets have generally not been designed to provide protection against other types of impacts, such as collisions (e.g., with fixed objects), which may benefit from different types of materials and/or configurations than those employed to maximize ballistics protection.

In recent times, military helmets have begun to include additional components that provide some ancillary functionalities. For example, communications systems, display systems, and/or other systems have been integrated into military helmets.

However, conventional military helmets tend to be universal solutions that do not provide for customization to accommodate personal preference, functionality required for a task at hand, specific responsibilities within a tactical group (e.g., communications, tactical command, etc.), and/or other motivations. Further, these helmets do not enable meaningful customization of protection.

SUMMARY

One aspect of the invention may relate to a helmet system that enables a user of the helmet system to customize the helmet system according to personal taste, a task at hand, responsibilities within a tactical group (e.g., communications, command, etc.), and/or according to other parameters. The customization of the helmet system may include a customization of electronics modules carried on the helmet system that optionally provide communications, environment detection, health or biometrics monitoring, power, information transmission/reception, information processing, and/or other functionalities. The customization of the helmet system may include a customization of structural components that enable the user to balance the structural protection provided to the user against other considerations. The other considerations may include, for example, weight, form factor, comfort, and/or other considerations.

In some implementations, the helmet system may include a ballistic protection structure and a chassis. The chassis may be provided on the exterior of the ballistic protection structure. The chassis may be removably secured to the ballistic protection structure. In order to facilitate the customization of the helmet system, the chassis may provide interfaces that enables the removable connection of modules to the helmet system. The modules may include electronics modules that provide environment detection, information processing, communications, information transmission/reception, power, health and/or biometrics monitoring, and/or other functionality. The modules may include modular panels that provide additional protection against impacts to the helmet system.

As was mentioned above, removable connections between electronics modules and/or modular panels and the chassis may enable the user of the helmet system to customize the configuration of the helmet system in accordance with personal preference, the task at hand, and/or responsibilities within a tactical group. For example, by adding or removing protective modular panels, the user can balance the weight, rigidity, and/or bulk of the helmet system against the additional impact protection afforded by the modular panels. Similarly, the user can add or remove electronic modules that enable various types of communications, environment detection, vision enhancement, situational awareness, information processing, information transmission/reception and/or other functionality.

In some implementations, in addition to physical connections with modules such as modular panels and/or electronics modules, the chassis provides for electronic connections with the electronics modules that are removably connectable. For example, the chassis may include one or more module connection ports. A given module connection port may include an electronic interface (e.g., a data port, a power port, a powered communication port, etc.) that enables one of the electronics modules to interface electronically with chassis. In some instances, a plurality of module connection ports may include the same type of interface, thereby enabling a single electronics module (or set of electronics modules) to be connected to any of the module connection ports having the same type of interface. In some instances, one or more of the module connection ports may include a unique type of interface that is not shared with any of the other module connection ports. This may require a certain electronics module, or a certain type of electronics module to be docked at specific locations on the chassis, while enabling other types of electronics modules to be docked at any number of locations on the chassis.

In some implementations, the chassis may carry a system of wiring that places individual ones of the module connection ports in communication with one another, places one or more of module connection ports in communication with a processor, a power source, or a communications device that is external to the helmet system, and/or provides for other types of connections with or between module connection ports. By way of non-limiting example, the wiring system of the chassis may include one or more buses that provides for communication and/or power delivery between the module connection ports and/or external components. To connect one or more of the module connection ports to a data source, a processor, and/or a power supply external to the helmet system, the wiring system of the chassis may be connected with an external system port provided on the helmet system. The wiring system may be formed integrally with the chassis (e.g., disposed within the chassis) or carried externally to the chassis.

According to various implementations, the electronics modules may be portable units that can selectively be connected to and disconnected from the helmet system by the user. To facilitate portability and comfort of the user, the electronics modules may be relatively light and have relatively small form factors. The user may connect and/or disconnect various ones of the electronics modules to the helmet system to configure the helmet system in accordance with personal preference, a task at hand, a role within a tactical group (e.g., communications, tactical command, etc.), and/or for other purposes.

To enable removable connection with the module connection ports of the chassis of the helmet system, a given one of the electronics modules may include a port interface. The port interface may include an electronic interface that enables electronic communication and/or power to be transferred between the system of wiring carried by the chassis and/or the given electronics module via one of the module connection ports on the chassis. In some instances, the port interface of the given electronics module may be configured to enable the given electronics module to connect with a plurality of the module connection ports (e.g., the module connection ports having a common interface). This may enable the given electronics module to be connected to the chassis at a variety of different possible locations. In some instances, the port interface of the given electronics module may be configured to connect only with one of the module connection ports.

The electronics modules may provide a range of functionality to the helmet system. By way of non-limiting example, the electronics modules may provide one or more of communication, situational awareness, environmental information detection, power, vision enhancement, and/or other functionality. For instance, a given electronics module may include a geolocation detector (e.g., a GPS sensor, etc.), a hostile threat detector (e.g., a sniper detector, etc.), a health or biometrics detector, and/or other detectors that generated output signals conveying information related to the environment in which the helmet system is being employed. The electronics modules may provide functionality other than environment detection. For example, a given electronics module may include a threat suppression system, such as a transmitter configured to jam frequencies that could be used to detonate explosives or carry enemy communications. As another example, a given electronics module may include one or more imaging sensors configured to generate output signals that convey information related to electromagnetic radiation that becomes incident thereon. For instance, an imaging sensor may include a common visible light imaging sensor (e.g., a CCD sensor chip), a long wave infrared thermal imaging sensor, a low light infrared imaging sensor, and/or other imaging sensors. As yet another example, a given electronics module may provide other functionality related to situational awareness (e.g., hyper spectral audio sensing, noise filtering or canceling hearing protection, inertial navigation systems, visual illuminators for friend or foe identification, and others), power, processing capabilities, wireless information transmission/reception capabilities, and/or other functionalities.

Another aspect of the invention relates to a modular helmet system that includes a non-rigid ballistic protection structure. The ballistic protection structure may be formed from a material that provides ballistic protection for the head of a user when the helmet system is disposed on the head of the user. In particular, the ballistic protection structure may provide protection against impacts that contact the exterior of the ballistic protection structure. For example, such impacts may be the product of ballistic projectiles, collisions (e.g., caused by crashes, falls, etc.), and/or other impacts. While the ballistic protection structure may enhance the protection of the helmet system to the user for various types of impacts, the ballistic protection structure may be the primary source of protection from high-speed ballistics such as, for example, bullets, shrapnel, and/or other projectiles. As the primary source of protection from high-speed ballistics, the ballistic protection structure provides the main source of structural integrity in the helmet system that prevents such ballistics from penetrating the helmet system. This does not mean that other components of the system may not provide any protection from high-speed ballistics, or that other components do not play a roll in absorbing the energy imparted on the helmet system by high-speed ballistics.

As was mentioned above, the ballistic protection structure may be non-rigid. In some implementations, the ballistic protection structure may be non-rigid and non-resilient, or "soft." While conventional helmets typically employ rigid shells as the primary source of ballistic protection, the formation of the ballistic protection structure from a non-rigid material may enhance one or more aspects of the helmet system. For example, the non-rigid material may enhance the comfort of the user by conforming to the surface of the head of the user, may enhance the comfort of the user by being lighter than rigid anti-ballistics materials, may reduce the bulk of the helmet system by being less bulky than conventional rigid anti-ballistics materials used in helmets, and/or other aspects of the helmet system. By way of non-limiting example, the material used to form the ballistic protection structure may include one or more of polyurethane, polyethylene, ultra-high molecular weight polyethylene, aramid, rigid-rod polymer poly{diimidazo pyridinylene(dihydroxy) phenylene}, and/or other materials.

Another aspect of the invention relates to a military helmet system that provides both protection against high-speed ballistics, and against collision impacts. In some implementations, the military helmet system may include a ballistic protection structure that provides a primary source of structural protection against ballistic projectiles, and an energy absorbing layer. The energy absorbing layer absorbs the energy imparted to the helmet system by impacts to the exterior of the ballistic protection structure. The absorption of energy imparted to the helmet system by the energy absorbing layer enhances the comfort and protection afforded to the user by the helmet system during impacts.

In some instances, the level of energy absorption provided by the energy absorbing layer may be greater than conventional military helmets that provide ballistics protection. While conventional military helmets provide some amount of energy absorption between a rigid ballistics resistant shell and the head of a user, the amount of energy absorption provided is typically relatively small. This is to reduce the weight, cost, bulk, and/or other aspects of conventional helmets.

The increased amount of energy absorption with respect to the energy absorption capacities of conventional anti-ballistics helmets provided by the energy absorbing layer, enhances the protection provided by the military helmet system to the user during impacts that are not involve high-speed ballistic projectiles. For example, in a collision with a fixed barrier (e.g., a tree, a building, a wall, etc.) a conventional military anti-ballistics helmet would afford marginal protection because of the relatively low amount of energy absorption provided. By contrast, in the same type of collision, the military helmet system set forth herein may provide an enhanced amount of protection because of the relatively high amount of energy absorption provided by the energy absorbing layer. By way of non-limiting example, the energy absorbing layer may provide protection conforming to Snell and other motor vehicle safety equipment standards. In some implementations, the energy absorbing layer may be formed from one or more of polyurethane, expanded polypropylene bead foams, injection molded and/or thermoformed plastic absorbers, styrenic foam and/or other materials.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
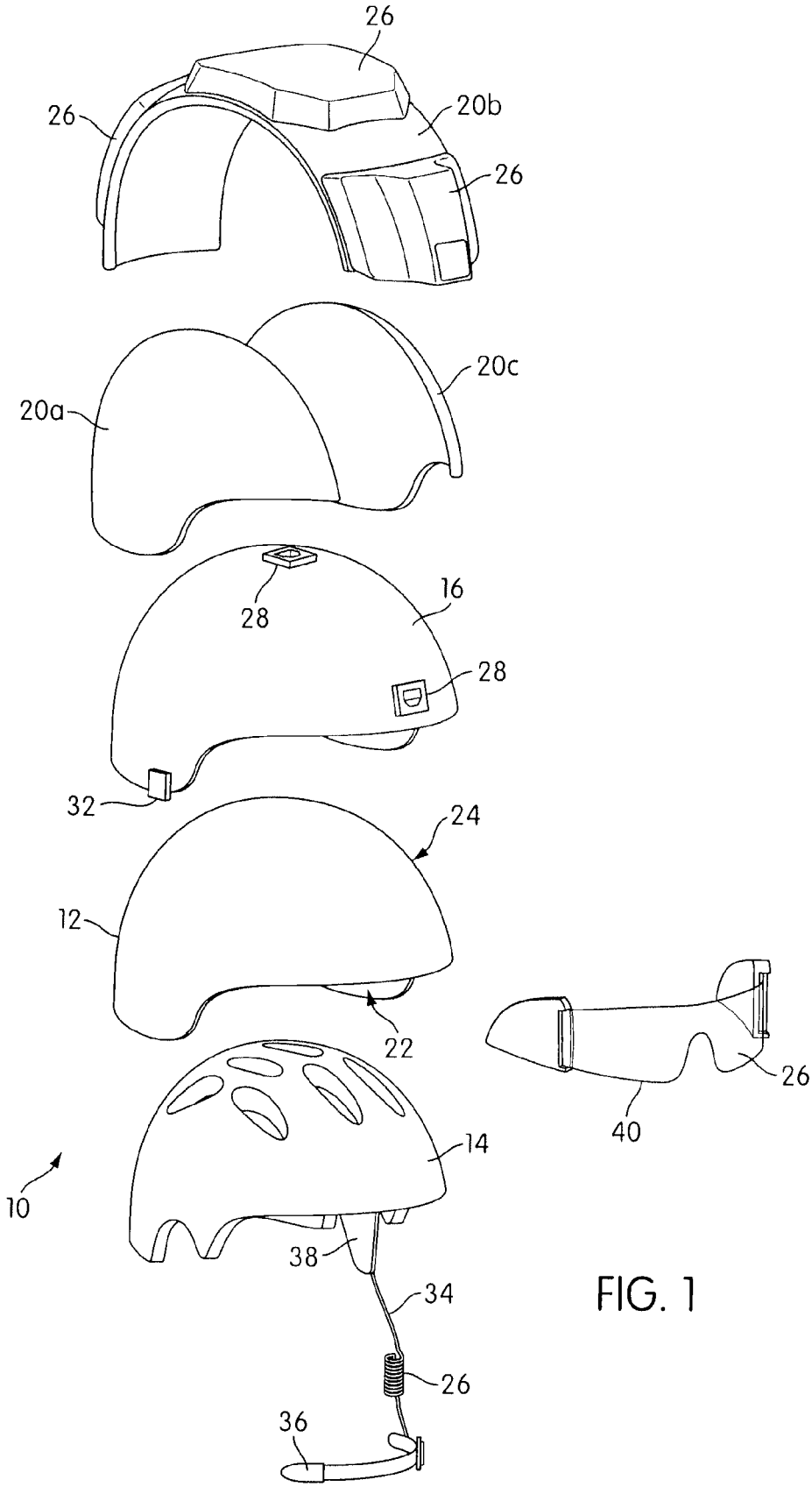
FIG. 1 illustrates an exploded view of a helmet system, in accordance with one or more embodiments of the invention.

FIG. 1 illustrates an exploded view of a helmet system 10, in accordance with one or more implementations of the invention. Helmet system 10 may be a modular system that enables various aspects of system 10 to be customized by a user. In some implementations, helmet system 10 may be configured for use as a military helmet for use by soldiers as a protective device providing protection against one more of ballistics, collisions, and/or other hazards. In addition to protection, helmet system 10 may provide one or more of communication, situational awareness, environmental information detection (geolocation detection, hostile threat detection, biometrics or health detection, etc.), power, vision enhancement, and/or other functionality. In some implementations, helmet system 10 may include one or more of a ballistic protection structure 12, an energy absorbing layer 14, a chassis 16, one or more modular panels 20 (illustrated in FIG. 1 as modular panels 20*a*, 20*b*, and 20*c*), and/or other components.

In some implementations, ballistic protection structure 12 may be shaped to accommodate the head of a user. In particular, the shape of ballistic protection structure 12 defines a cavity, or interior 22, and an exterior 24. Interior 22 is adapted to accommodate the head of the user. Ballistic protection structure 12 may be formed from a material that provides ballistic protection for the head of a user when helmet system 10 is disposed on the head of the user. In particular, ballistic protection structure 12 may provide protection against impacts that contact exterior 24. For example, such impacts may be the product of ballistic projectiles, collisions (e.g., caused by crashes, falls, etc.), and/or other impacts. While ballistic protection structure 12 may enhance the protection of system 10 to the user for various types of impacts, ballistic protection structure 12 may be the primary source of protection from high-speed ballistics such as, for example, bullets, shrapnel, and/or other projectiles. As the primary source of protection from high-speed ballistics, ballistic protection structure 12 provides the main source of structural integrity in system 10 that prevents such ballistics from penetrating system 10. This does not mean that other components of system 10 do not provide any protection from high-speed ballistics, or that other components do not play a roll in absorbing the energy imparted on system 10 by high-speed ballistics.

According to various implementations of the invention, ballistic protection structure 12 may be non-rigid. In some implementations, ballistic protection structure 12 may be non-rigid and non-resilient, or "soft." While conventional helmets typically employ rigid shells as the primary source of ballistic protection, the formation of ballistic protection structure 12 from a non-rigid material may enhance one or more aspects of system 10. For example, the non-rigid material may enhance the comfort of the user by conforming to the surface of the head of the user, may enhance the comfort of the user by being lighter than rigid anti-ballistics materials, may reduce the bulk of system 10 by being less bulky than conventional rigid anti-ballistics materials used in helmets, may provided a higher level of ballistic protection for specific threats, and/or other aspects of system 10. By way of non-limiting example, the material used to form ballistic protection structure 12 may include one or more of polyurethane, polyethylene, ultra-high molecular weight polyethylene, aramid, rigid-rod polymer poly{diimidazo pyridinylene(dihydroxy)phenylene}, and/or other materials.

In some implementations, energy absorbing layer 14 absorbs the energy imparted to helmet system 10 by impacts to exterior 24 of ballistic protection structure 12. The absorption of energy imparted to helmet system 10 by energy absorbing layer 14 enhances the comfort and protection afforded to the user by helmet system 10 during impacts. In some instances, the level of energy absorption provided by energy absorbing layer 14 may be greater than conventional military helmets that provide ballistics protection. While conventional military helmets provide some amount of energy absorption between a rigid ballistics resistant shell and the head of a user, the amount of energy absorption provided is typically relatively small. This is to reduce the weight, cost, bulk, and/or other aspects of conventional helmets. However, some of the weight savings, bulk reduction, and/or other enhancements provided by the non-rigid material of ballistic protection layer 12 may enable energy absorbing layer to be heavier, bulkier, and/or provide more non-ballistic impact protection than in conventional helmets without increasing the overall budget for these aspects of helmet system 10 in comparison with conventional helmets.

The increased amount of energy absorption with respect to the energy absorption capacities of conventional anti-ballistics helmets provided by energy absorbing layer 14 enhances the protection provided by helmet system 10 to the user during impacts that are not involve high-speed ballistic projectiles. For example, in a collision with a fixed barrier (e.g., a tree, a building, a wall, etc.) a conventional military anti-ballistics helmet would afford marginal protection because of the relatively low amount of energy absorption provided. By contrast, in the same type of collision, helmet 10 would provide an enhanced amount of protection because of the relatively high amount of energy absorption provided by energy absorbing layer 14. By way of non-limiting example, energy absorbing layer 14 may provide the same level of protection provided by protective equipment conforming to Snell and other motor vehicle safety requirements. In some implementations, energy absorbing layer 14 may be formed from one or more of polyurethane, expanded polypropylene bead foams, injection molded and/or thermoformed plastic absorbers, styrenic foam, and/or other materials.

Although energy absorbing layer 14 is shown in FIG. 1 as a single layer, this is not intended to be limiting. In some implementations, energy absorbing layer 14 may be formed as a plurality of sub-layers. When helmet system 10 is assembled, energy absorbing unit 14 is attached to ballistic protection structure 12. This attachment may be removable, for example, for storage and/or transport, for cleaning, to enable the user to wear ballistic protection structure 12 separately from energy absorbing layer 14, and/or for other reasons. The removable attachment of energy absorbing unit 14 to ballistic protection structure 12 may be accomplished by removal of a retaining ring around the perimeter of the helmet, and/or via other mechanisms for removable attachment. In some implementations, the attachment of energy absorbing unit 14 to ballistic protection structure 12 may be permanent.

In some implementations, chassis 16 provides a body onto which a plurality of modules can be removably connected. Chassis 16 may be attached to ballistic protection structure 12 on exterior 24 of ballistic protection structure 12. This attachment may be permanent, or the attachment may be removable. The use of a removable attachment between chassis 16 and ballistic protection structure 12 may enable the user to configure helmet system 10 for a specific use.

The modules that are removably connected to chassis 16 on exterior 24 of ballistic protection structure 12 may include modules that provide detection, information processing, communications, power, and/or other functionality, and/or modules that provide additional protection against impacts. For example, the modules may include one or both of electronics modules 26 and/or modular panels 20. The removable connections between electronics modules 26 and/or modular panels 20 enable the user of helmet system 10 to customize the configuration of helmet system 10 in accordance with his preference and/or the task at hand. For example, by adding or removing modular panels 20, the user can balance the weight, rigidity, and/or bulk of helmet system against the additional impact protection afforded by helmet system 10. Similarly, the user can add or remove electronic modules 26 that enable various types of communications, environment detection, vision enhancement, situational awareness, and/or other functionality.

In order to enable the removable connection of modular panels 20 to chassis 16, chassis 16 may include a plurality of panel interfaces 28. Panel interfaces 28 may provide a connection between modular panels 20 and chassis 16 strong enough that modular panels 20 provide additional protection during impacts. To connect modular panels 20 to chassis 16, panel interfaces 28 may include one or more elastomeric electrical connectors, perimeter retaining ring and fasteners, and/or other mechanisms for removably connecting mechanical components.

According to various implementations, more than one set of modular panels 20 may be provided for removable connection with chassis 16. For example, one set of modular panels 20 may provide less structural protection, but may have an enhanced lightness or breathability, and/or a reduced bulk, while another set of modular panels 20 may provide an enhanced amount of structural protection, but are relatively heavy and/or bulky. Similarly, different sets of modular panels 20 may be configured to enable different kinds of electronics modules 26 to be selectively carried on helmet system 10, or some modular panels 20 may even have certain electronics modules 26 provided integrally therewith.

In some implementations, in addition to physical connections with modules, chassis 16 may provide for electronic connections with electronics modules 26 that are removably connectable. For example, chassis 16 may include one or more module connection ports 30. A given module connection port 30 may include an electronic interface (e.g., a data port, a power port, a powered communication port, etc.) that enables one of electronics modules 26 to interface electronically with chassis. In some instances, a plurality of module connection ports 30 may include the same type of interface, thereby enabling a single electronics module 26 (or set of electronics modules 26) to be connected to any of module connection ports 30 having the same type of interface. In some instances, one or more of module connection ports 30 may include a unique type of interface that is not shared with any of the other module connection ports 30. This may require certain types of electronics modules 26 to be docked at specific locations on chassis 16, while enabling other types of electronics modules 26 to be docked at any number of locations on chassis 16.

In some implementations, chassis 16 may carry a system of wiring (not shown) that places individual ones of the module connection ports 30 in communication with one another, places one or more of module connection ports 30 in communication with a processor, a power source, or a communications device that is external to helmet system 10, and/or provides for other types of connections with or between module connection ports 30. By way of non-limiting example, the wiring system of chassis 16 may include one or more buses that provides for communication and/or power delivery between module connection ports 30 and/or external components. To connect one or more of module connection ports 30 to a data source, a processor, and/or a power supply external to helmet system 10, the wiring system of chassis 16 may be connected with an external system port 32.

According to various implementations, electronics modules 26 removably connect directly to module connection ports 30. However, this is not intended to be limiting. In some implementations, electronics modules 26 are removably connected to one of modular panels 20 (e.g., modular panel 20*b*) such that if the modular panels 20 are connected to chassis 16, the electronics modules 26 connected to the modular panels 20 are placed in communication with module connection ports 30 (e.g., either directly, or via a connection provided integrally with modular panel 20).

Electronics modules 26 may be portable units that can selectively be connected and disconnected from helmet system 10 by the user. To facilitate portability and comfort of the user, electronics modules 26 may be relatively light and have relatively small form factors. The user may connect and/or disconnect various ones of electronics modules 26 to helmet system 10 to configure helmet system 10 in accordance with personal preference, a task at hand, a role within a group of soldiers (e.g., communications, tactical command, etc.), and/or for other purposes.

To enable removable connection with module connection ports 30, a given one of electronics modules 26 may include a port interface. The port interface may include an electronic interface that enables electronic communication and/or power to be transferred between the system of wiring carried by chassis 16 and/or the given electronics module 26 via one of module connection ports 30. In some instances, the port interface of the given electronics module 26 may be configured to enable the given electronics module 26 to connect with a plurality of module connection ports 30. This may enable the given electronics module 26 to be connected to chassis 16 at a variety of different possible locations. In some instances, the port interface of the given electronics module 26 may be configured to connect only with one of module connection ports 30.

Electronics modules 26 may provide a range of functionality to helmet system 10. By way of non-limiting example, electronics modules 26 may provide one or more of communication, situational awareness, environmental information detection, power, vision enhancement, and/or other functionality. For instance, a given electronics module 26 may include a geolocation detector (e.g., a GPS sensor, etc.), a hostile threat detector (e.g., a sniper detector, etc.), a health or biometrics detector, and/or other detectors that generated output signals conveying information related to the environment in which helmet system 10 is being employed. Electronics modules 26 may provide functionality other than environment detection. For example, a given electronics module 26 may include a threat suppression system, such as a transmitter configured to jam frequencies that could be used to detonate explosives or carry enemy communications. As another example, a given electronics module 26 may including one or more imaging sensors configured to generate output signals that convey information related to electromagnetic radiation that becomes incident thereon. For instance, an imaging sensor may include a long wave infrared thermal imaging sensor, a low light infrared imaging sensor, and/or other imaging sensors. As yet another example, a given electronics module 26 may provide other functionality related to situational awareness (e.g., sniper warning system), power, processing capabilities, wireless information transmission/reception capabilities, and/or other functionalities.

In some implementations, electronics modules 26 include a communications module 28 that is removably connected with chassis 16. Communications module 34 may include a microphone 36, one or more speakers 38, and/or other components that facilitate audio communications between the user and other entities. Microphone 36 may be configured to capture audible communications uttered by the user. Speakers 38 may be configured to generate sounds associated with audio communications generated externally from the user and transmitted to the user. In some instances, one or more of processing, power, and/or transmission/reception functionality that enable communications with the user via microphone 36 and/or speaker(s) 38 are provided in communications module 34. In some instances, one or more of processing, power, and/or transmission/reception functionality that enable communications with the user via microphone 36 and/or speaker(s) 38 are provided by components external to system 10 (e.g., carried on the torso of the user), and information and/or power is transmitted between communications module 34 and the external component(s) via the wiring system of chassis 16. In some instances, one or more of processing, power, and/or transmission/reception functionality that enable communications with the user via microphone 36 and/or speaker(s) 38 are provided by one or more electronics modules 26 other than communications module 34, and information and/or power is transmitted between communications module 34 and the other ones of electronics modules 26 via the wiring system of chassis 16.

In some implementations, electronics modules 26 may include a display module 40. Display module 40 may present visual information to the user of system 10. In some instances, display module 40 is a look through display that includes a screen that wraps around in front of the eyes of the user. The screen may enable the user to selectively view information formed on the screen, information behind the screen (as the user looks through the screen), and/or both information formed on the screen and information behind the screen. Display module 40 may provide information to the user generated by one or more other electronics modules 26, information received (e.g., via external system port 32), and/or both types of information.

Figure 2:
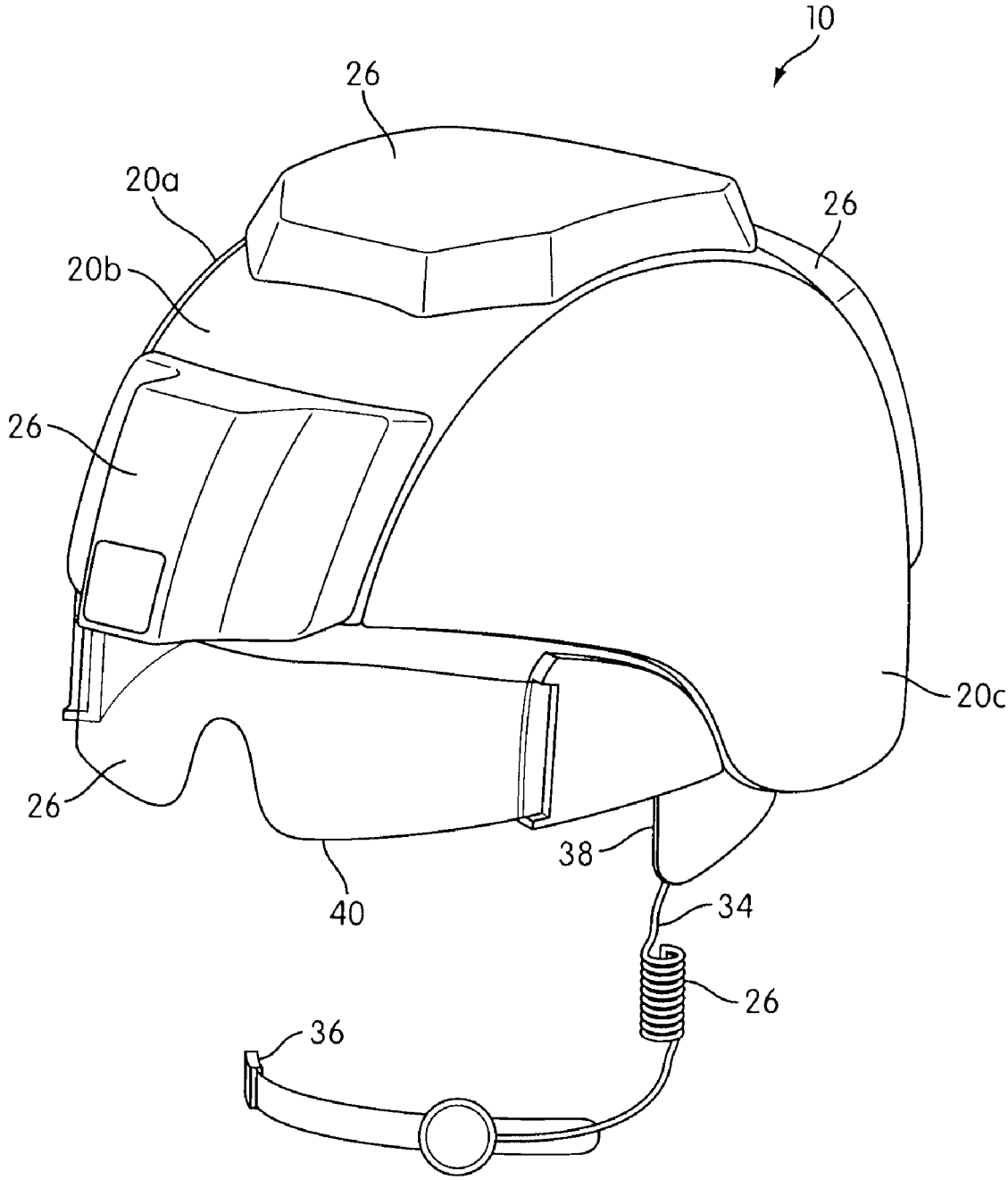
FIG. 2 illustrates a view of an assembled helmet system, according to one or more embodiments of the invention.

FIG. 2 illustrates a view of helmet system 10 assembled, in accordance with one or more implementations of the invention. It should be appreciated from the foregoing, that system 10 is "assembled" in FIG. 2 in one of a plurality of possible configurations that are selectable by the user. In the configuration shown in FIG. 2, system 10 includes modular panels 20, and a plurality of electronics modules 26 removably connected to chassis 16 (not shown in FIG. 2). This view if provided merely for illustrative purposes, as system 10 may be configured by the user in other instances to include less (and/or or different) electronics modules 26 and less (and/or different) modular panels 20.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A helmet comprising:

a protective structure shaped to be worn on a head of a user, the protective structure being formed from a material that provides ballistic protection for the head of the user; and a chassis provided with the protective structure, the chassis comprising:

a plurality of module connection ports configured to receive electronics modules removably connected to the helmet separately from each other; and a system of wiring carried by the chassis that places individual ones of the plurality of connection ports in electronic communication with other ones of the plurality of connection ports so that information can be exchanged therebetween.

2. The helmet of claim 1, wherein the chassis is formed separately from the protective structure, and is attached to the protective structure.

3. The helmet of claim 1, wherein the chassis is provided on the exterior of the protective structure.

4. The helmet of claim 3, wherein the chassis further comprises one or more panel interfaces that enable one or more modular panels to be removably attached to the helmet.

5. The helmet of claim 4, wherein the panel interfaces provide an attachment to the one or more modular panels secure enough such that the one or more modular panels provide supplemental protection for the head of the user.

6. The helmet of claim 1, wherein the system of wiring includes a bus.

7. The helmet of claim 1, further comprising an energy absorbing layer inside of the protective structure.

8. The helmet of claim 1, wherein the protective structure is not rigid.

9. The helmet of claim 1, wherein the chassis further comprises an external system port configured to provide an interface between electronic modules connected to the chassis and an external processor and/or power source.

10. A helmet system, the system comprising:

a protective structure shaped to be worn on a head of a user, the protective structure being formed from a material that provides ballistic protection for the head of the user;

a chassis provided with the protective structure, the chassis comprising:

a plurality of module connection ports configured to receive electronics modules removably connected to the helmet separately from each other; and a system of wiring carried by the chassis that connects to electronics modules removably connected to module connection ports; and one or more electronics modules configured to be removably connected to the chassis at the module connection ports, wherein the one or more electronics modules comprise at least one electronics module that generates an output signal conveying information related to the environment in which the helmet system is disposed.

11. The system of claim 10, wherein the one or more electronics module comprises one or more of a geolocation detector, a hostile threat detector, or a biometrics sensor, visual and other electromagnetic spectrum sensors including IR, UV, microware and other sensors.

12. The system of claim 10, wherein the chassis is formed separately from the protective structure, and is attached to the protective structure.

13. The system of claim 10, wherein the chassis is provided on the exterior of the protective structure.

14. The system of claim 13, wherein the chassis further comprises one or more panel interfaces that enable one or more modular panels to be removably attached to the helmet.

15. The system of claim 14, further comprising one or more modular panels that are removably attached to the helmet at the one or more panel interfaces on the chassis, wherein the one or more modular panels provide supplemental protection for the head of the user.

16. The system of claim 15, wherein the one or more modular panels carry at least one of the electronics modules.

17. The system of claim 10, wherein the system of wiring places individual ones of the plurality of connection ports in electronic communication with other ones of the plurality of connection ports so that information can be exchanged therebetween.

18. The system of claim 17, wherein the system of wiring includes a bus.

19. The system of claim 10, further comprising an energy absorbing layer inside of the protective structure.

20. The system of claim 10, wherein the protective structure is not rigid.

21. The system of claim 10, wherein the chassis further comprises an external system port in electronic communication with the system of wiring, the external system port providing an interface between electronic modules connected to the chassis and an external processor and/or power source.

* * * * *